US012246235B2

(12) United States Patent
Coonts

(10) Patent No.: US 12,246,235 B2
(45) Date of Patent: Mar. 11, 2025

(54) ROTATION SPORTS TRAINING SYSTEM AND METHOD

(71) Applicant: Coonts Golf, LLC, Henderson, NV (US)

(72) Inventor: Tyler Coonts, Henderson, NV (US)

(73) Assignee: Coonts Golf, LLC, Henderson, NV (US)

( * ) Notice: Subject to any disclaimer, the term of this patent is extended or adjusted under 35 U.S.C. 154(b) by 219 days.

(21) Appl. No.: 18/064,925

(22) Filed: Dec. 12, 2022

(65) Prior Publication Data

US 2023/0191225 A1 Jun. 22, 2023

Related U.S. Application Data

(60) Provisional application No. 63/290,352, filed on Dec. 16, 2021.

(51) Int. Cl.

| | |
|---|---|
| ***A63B 69/36*** | (2006.01) |
| *A63B 69/00* | (2006.01) |
| *A63B 69/38* | (2006.01) |

(52) U.S. Cl.

CPC ..... *A63B 69/362* (2020.08); *A63B 69/3608* (2013.01); *A63B 2069/0008* (2013.01); *A63B 69/38* (2013.01); *A63B 2209/10* (2013.01); *A63B 2220/833* (2013.01)

(58) Field of Classification Search

CPC ..... A63B 69/362; A63B 69/3608; A63B 69/38; A63B 2069/0008; A63B 2209/10; A63B 2220/833; A63B 2071/0694; A63B 2214/00; A63B 2225/093; A63B 2225/50; A63B 69/0002; A63B 2225/09

USPC ..... 473/205, 213–216, 229, 257, 276, 277

See application file for complete search history.

(56) References Cited

U.S. PATENT DOCUMENTS

| | | | | |
|---|---|---|---|---|
| 1,669,457 A | | 5/1928 | Dailey | |
| 2,103,502 A | | 12/1937 | Leo | |
| 3,595,583 A | | 7/1971 | Oppenheimer | |
| 4,422,643 A | | 12/1983 | Cushing | |
| 4,582,325 A | | 4/1986 | Yuhara | |
| 4,883,276 A | | 11/1989 | Brown | |
| 5,013,044 A | * | 5/1991 | Hesselbart | A63B 69/3621 473/218 |
| 5,303,926 A | * | 4/1994 | Owens | A63B 69/3621 473/274 |
| 5,441,271 A | | 8/1995 | Briggs | |
| 5,443,266 A | | 8/1995 | Bursi | |
| 5,569,095 A | | 10/1996 | McCollum | |

(Continued)

*Primary Examiner* — Nini F Legesse

(74) *Attorney, Agent, or Firm* — Connie R. Masters

(57) ABSTRACT

A sports rotation swing training system is provided that includes a harness assembly to be worn around the torso of the player that is used with a separate vertical upright structure. The harness assembly comprises a chest/waist band and a generally horizontally projecting stick protruding from the band side. The projecting stick is designed to engage with the separate upright structure upon the player's execution of a swing to provide feedback (auditory, tactile, or electronic) related to the degree of rotation. The chest/waist band can be alternatively positioned by the user at the chest (to practice thoracic rotation) or at the waist (to practice pelvic rotation). In a preferable aspect of the invention, the angle of the projecting stick is adjustable downward from generally parallel to the ground.

17 Claims, 12 Drawing Sheets

(56) References Cited

U.S. PATENT DOCUMENTS

| | | | | |
|---|---|---|---|---|
| 5,643,097 | A | 7/1997 | Bechler et al. | |
| 5,658,203 | A | 8/1997 | Shub | |
| 5,785,603 | A * | 7/1998 | Lazier | A63B 69/3608 273/DIG. 30 |
| D404,103 | S * | 1/1999 | Winters | D21/791 |
| 6,206,787 | B1 * | 3/2001 | Kleppen | A63B 69/0059 473/212 |
| 6,270,430 | B1 | 8/2001 | Nicoloff | |
| 6,458,036 | B1 | 10/2002 | Gutierrez | |
| 6,503,148 | B2 | 1/2003 | Lane | |
| 6,994,633 | B2 | 2/2006 | Czaja et al. | |
| 7,066,825 | B1 | 6/2006 | Moussa | |
| 7,399,232 | B1 | 7/2008 | Frappier et al. | |
| 7,431,661 | B1 * | 10/2008 | Cailey | A63B 69/0057 473/262 |
| 7,686,699 | B2 | 3/2010 | Snyders | |
| 7,766,757 | B2 | 8/2010 | Brooks et al. | |
| D654,131 | S | 2/2012 | Crabtree | |
| 8,157,665 | B2 | 4/2012 | Gibbs | |
| 8,277,331 | B2 | 10/2012 | Whitt et al. | |
| 8,425,343 | B1 | 4/2013 | Olmos | |
| 8,562,451 | B2 | 10/2013 | Crabtree | |
| 9,283,462 | B2 | 3/2016 | Asedo | |
| 9,604,119 | B2 | 3/2017 | Kronzer | |
| 9,956,467 | B2 | 5/2018 | Vehslage | |
| 2003/0109320 | A1 * | 6/2003 | Perry | A63B 69/3608 473/215 |
| 2003/0220168 | A1 | 11/2003 | Perry | |
| 2011/0201438 | A1 | 8/2011 | Butts et al. | |
| 2013/0177886 | A1 | 7/2013 | McLaughlin | |
| 2016/0236052 | A1 * | 8/2016 | Sunday | A63B 69/00 |
| 2018/0264339 | A1 * | 9/2018 | Yang | A63B 71/023 |

* cited by examiner

ROTATION SPORTS TRAINING SYSTEM AND METHOD

FIELD OF INVENTION

This invention relates generally to a system and method for teaching and/or practicing rotation of the body during training for one or more sports activities, and more particularly to a swing training system and method using feedback to encourage proper pelvic and/or thoracic rotation of the player's body.

BACKGROUND OF THE INVENTION

Swinging a sports implement, such as a golf club, baseball bat, or tennis racket, is essentially a blend of lateral and rotary movements. Ideally, these two movements are blended and occur in the proper sequence. Unfortunately, many sports players have too much lateral movement, and not enough rotary movement.

Rotary movement, or the act of rotating the body right to left (and vice versa), generates speed and creates a sequence of movements that allow for better contact with the ball. When a player lacks sufficient rotary movement, he or she fails to open the lower and/or upper body enough to make the most efficient strike with his/her club, bat, racket, or the like. It is known that allowing the pelvis and rib cage to rotate open toward the target is a key performance indicator in many sports.

Proper rotation training of not only the upper body but also of the lower body, is vital to achieve consistent swing performance. The study of biomechanical data has shown that to achieve a rotation of the thorax of approximately 10 degrees, the pelvis should be rotated approximately 30 degrees. As a swing begins, the lower and upper body act independently with the lower body naturally beginning to rotate before the upper body. It can be thought of as the chest area working to catch up to the lower body. Not only does the lower body rotate earlier, but it also rotates to a greater degree than the upper body. Because during rotation the upper body lags the lower body, without training, the upper body is often not sufficiently open at the moment of impact but only achieves the proper rotation just after impact.

Instructors can provide guidance and encouragement to the player to properly rotate his/her lower body (pelvic rotation) and upper body (thoracic rotation), but a rotation training system that provides feedback to the player to encourage proper rotation provides advantages over in-person coaching.

Accordingly, there is a need in the art for a system and method to assist the player in practicing proper pelvic and/or thoracic rotation to improve the sport player's swing.

SUMMARY OF THE INVENTION

The present invention is directed to a rotation training system for use in swing practice for sports, which includes a harness assembly used with a separate, typically freestanding, upright structure (such as a pole, shaft, rod, stick, tube, pipe, wand, or other similar tall thin object). The harness assembly includes a chest/waist band for encircling the player's chest or waist, shoulder straps (optionally but preferably) that are removable from the chest/waist band, and a projecting stick (such as a shaft, rod, tube, pipe, wand, rod, or the like) that protrudes laterally and extends generally horizontally from the side of the chest/waist band.

The band's projecting stick is designed to engage with the separate upright structure upon execution of a swing to provide auditory, tactile, and/or electronic feedback. As the player being trained rotates during a swing, the projecting stick also rotates to strike the upright structure. As seen in FIG. 7, the upright structure has been placed at a specified location in which, if a player rotates the body to the desired angle of rotation, the impact of the projecting stick striking the upright structure will be heard and/or felt before the golf club hits the ball. If the impact of the projecting stick colliding with the upright structure is heard and/or felt after the golf club hits the ball, the player will know the desired rotation has not been achieved and continued practice using the sport rotation training system is needed.

Though the figures illustrate the swing as a golf swing, the invention is applicable to swing training for other sports, such as baseball, softball, tennis, and the like. The placement of the separate upright structure can be varied to create the proper feedback for the particular rotation being taught.

The chest/waist band can be positioned on the player being trained at the level of the waist to train his/her swing in the rotary movements of the lower body (via pelvic rotation) or alternatively can be positioned on the player at the level of the chest to train his/her swing in the rotary movements of the upper body (via thoracic rotation). Because the chest/waist band may be worn alternatively at the waist or the chest, the rotation training system comprises an efficient, economical two-in-one training system.

The rotation training system is effective in helping a player learn how to gain rotary movement in his/her swing. In the typical method of use, the player first positions the chest/waist band at the level of the waist and trains the lower body in proper rotation (and/or assesses the rotation of the lower body to determine if the desired rotation is being achieved). When the lower body is trained to dependably open with a sufficient rotation, the chest area may reflexively open, also, to at least a degree. In some players, with only this training of the proper rotation of the lower body, the chest area will instinctively also rotate to a degree that is sufficiently open at impact. Yet, for many players, getting his/her lower body to rotate enough does not ensure that his/her upper body will rotate adequately. For these players, the thoracic rotation is stalled. An advantage of the two-in-one rotation training system herein disclosed is that it addresses this problem without additional equipment. The chest/waist band may be re-positioned from the waist level to the chest level to additionally train the player's thoracic rotation. To accomplish this the chest/waist band is worn as a chest harness with the stick protruding laterally from the body's midline just under the player's lead armpit. Using the chest/waist band in this position will inform the player as to whether he/she has rotated or opened his/her chest enough before impact with the ball.

Thus, using the rotation training system teaches the player to consistently both rotate the hips and open the chest area to the proper degree, which is vital to consistent and effective ball striking.

In one aspect of the invention, the shoulder straps are removable from the chest/waist band.

In another aspect of the invention, the shoulder straps are permanently attached to the chest/waist band.

In a further aspect of the invention, the harness assembly does not include shoulder straps.

In one aspect of the invention, complementary portions of the strap attachment/detachment devices are disposed on the top portion of the chest/waist band to engage the shoulder straps.

In another aspect of the invention, complementary portions of the strap attachment/detachment devices are disposed on both the top portion of the chest/waist band and on the bottom portion of the chest/waist band.

In one aspect of the invention, the chest/waist band includes a band closure to join a proximal end of the chest/waist band to a distal end of the chest/waist band.

In an additional aspect of the invention, the chest/waist band has a sufficient degree of stretch to be donned, so that it does not need and does not have a band closure to connect opposing ends of the chest/waist band.

In one aspect of the invention, the rotation swing training system includes the separate vertical upright structure.

In a further aspect of the invention, the rotation swing training system does not include the separate vertical upright structure, which may be separately provided by the user of the invention.

In one aspect of the invention, the generally horizontally projecting stick is attached to the chest/waist band in a fixed, non-adjustable position.

In another aspect of the invention, the generally horizontally projecting stick is adjustably attached to the chest/waist band.

In a further aspect of the invention, the generally horizontally projecting stick is adjustably attached to the chest/waist band to provide two angles of inclination.

In an additional aspect of the invention, the generally horizontally projecting stick is adjustably attached to the chest/waist band to provide three angles of inclination.

In another aspect of the invention, the horizontally projecting stick is manually adjusted between at least two angles of inclination.

In one aspect of the invention, the rotation swing training system comprises one or more electronic systems to determine the angle of rotation of the body during all or part of the swing.

In another aspect of the invention, the rotation swing training system comprises system electronics to determine the angle of rotation of the body during all or part of the swing and a report system to report the angle of rotation to the player or to the trainer.

In a further aspect of the invention, the system electronics and report system are in communication with a mobile phone application, with the mobile phone display serving to report the angle of rotation to the player or to the trainer.

In an additional aspect of the invention, the separate vertical upright structure comprises an impact sensor to electronically detect the timing of the impact of the projecting stick with the separate vertical upright structure to provide the degree of rotation from the start of the swing to the moment of impact.

The object of the invention is to provide a system and method to train a user in rotation of the body, particularly for practicing a swing, which gives an improved performance over prior art systems and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a rotation training system 100 used for training and improving a sport player's swing. The rotation training system 100 is designed to provide feedback and to assist in player development in a variety of sports, such as golf, baseball, tennis, by helping the player learn how to gain rotary movement in his/her body during his/her swing.

Figure 2:
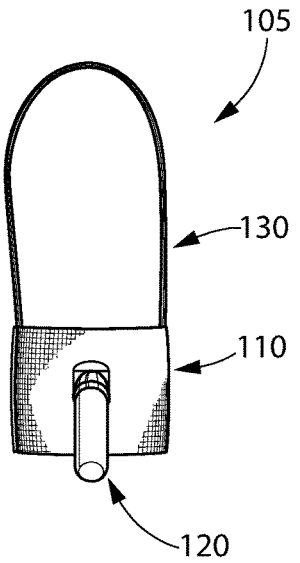
FIG. 2 is a right side view of a harness assembly including a chest/waist band with a projecting stick of the first embodiment of the rotation training system of the present invention.

In a first and a second embodiment, the rotation training system 100 of the present invention may suitably comprise, consist of, or consist essentially of a harness assembly 105 (FIG. 2) including a chest/waist band 110 with a laterally projecting stick 120. The rotation training system 100 of these embodiments is used with a separately provided upright structure 150.

In a third embodiment, the rotation training system of the present invention may suitably comprise, consist of, or consist essentially of both a harness assembly 105 and a separate upright structure 150, which is independent of the harness assembly 105.

In a fourth embodiment, the rotation training system of the present invention may suitably comprise, consist of, or consist essentially of a harness assembly 105, a separate upright structure 150, and an electronics system 180, 190 for determining at least the degree of rotation.

Figure 1:
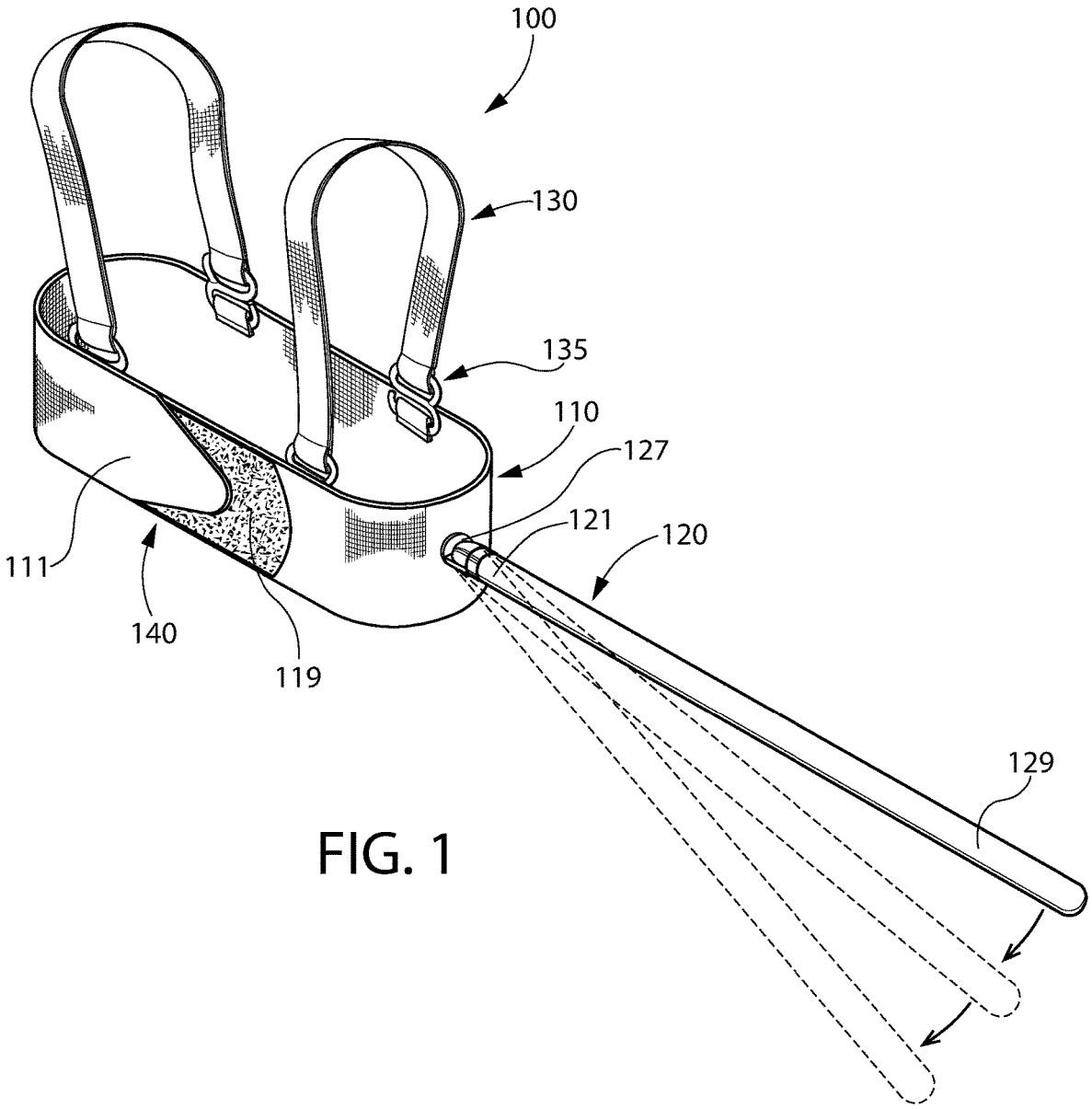
FIG. 1 is a top perspective view of a harness assembly including a chest/waist band with a projecting stick of a first embodiment of the rotation training system of the present invention.

Referring now to FIG. 1, a rotation training system, shown generally as reference number 100, is illustrated in accordance with the first embodiment of the present invention. As shown, the rotation training system comprises a harness assembly 105 including a chest/waist band 110 configured with an outwardly projecting stick 120. The projecting stick 120 is designed to engage with a separate upright structure 150 (shown in FIGS. 4-9) upon execution of proper rotation during a golf swing to provide auditory and/or tactile feedback (or in the fourth embodiment, to provide electronic feedback) to indicate to the player if the desired degree of rotation was achieved before the club, racket, or bat hits the ball.

The chest/waist band 110 includes a band front, a band back, and two opposing band sides, which are preferably formed integrally. The projecting stick 120 is attached to one of the two opposing band sides.

The chest/waist band 110 is a strip of flexible material, such as fabric, canvas, webbing, leather, vegan leather, complementary loop or hook fabric, or other similar material. The chest/waist band 110 is long enough to fit around the chest and the waist of the player to be trained, such as from 35 to 70 inches in circumference with an additional length allowance for overlapping the opposing ends to create a closure. The chest/waist band 110 is not thick (does not extend outwardly from the player's body over 1.5 inches), thus allowing freedom of movement. The chest/waist band 110 has a vertical height that is tall enough to be comfortable and to support the projecting stick 120 but is short enough to avoid impeding movement or performance. The height of the chest/waist band 110 may be in the range of from 1 inch to 9 inches, and it may preferably be in the range of 2 to 6 inches, and is most preferably in the range of from 3.5 to 5 inches.

The projecting stick 120 is attached in a generally horizontal (or angled slightly downward) orientation at the side of the chest/waist band 110. When the chest/waist band 110 is positioned at the player's chest, the projecting stick 120 protrudes laterally from the body's midline just under the player's lead armpit. When the chest/waist band 110 is positioned at the player's waist, the projecting stick 120 protrudes laterally from the midline of the lead side of the player's waist. When the player rotates his/her body to execute a swing, the projecting stick 120 also rotates to strike the upright structure 150, which has previously been located at the correct position to provide the feedback of interest in the rotation training.

The projecting stick 120 has a width in the range of 0.5 inches to 3 inches. The length of the projecting stick 120 from the stick proximal end 121 to the stick distal end 129 may be in the range of 1 foot to 4 feet, may preferably be in the range of 1.5 to 3.5 feet, and is most preferably between 2 and 3 feet in length. The diameter or width of the projecting stick 120 can be in the range of ⅛ inch to 1.5 inches and is preferably in the range of ⅛ to ⅕ inches. The projecting stick 120 may be formed of metal, wood, plastic, or other natural or manmade material.

The proximal portion of the band-to-stick connector 125 is fixedly attached to the chest/waist band 110. The distal portion of the band-to-stick connector 125 receives the projecting stick 120 and holds it stably in at a position generally horizontal (parallel to the ground) or angled slightly downward.

In one aspect of the invention, the projecting stick 120 is fixedly attached via a band-to-stick connector 125 at a permanent angle to the chest/waist band 110.

In a preferred aspect shown in the first and the second embodiments, the projecting stick 120 is attachable/detachable from the band 110 and is adjustable in angle. In this aspect, the band-to-stick connector 125 is adjustable to allow the stick 120 to be positioned at more than one angle, with one angle generally horizontal and parallel with the ground (forming a right angle with the portion of the chest/waist band 110 below the band-to-stick connector 125) with the other angle (or angles) forming an acute angle (or acute angles) in which the distal end of the stick 120 is closer to the ground.

In the first embodiment, the band-to-stick connector 125 includes an angle mount 123 that is adjustable, that receives the proximal end of the projecting stick 120, and that allows the projecting stick 120 to be held generally horizontally or angled downwardly from horizontal. The band-to-stick connector 125 comprises a mating portion 127 that connects the band-to-stick connector 125 to the chest/waist band 110 and an adjustable angle mount 123 disposed at the outer or distal portion of the band-to-stick connector 125 that enables the stick 120 to be moved into at least one additional angle. The proximal end of the projecting stick 120 is detachably received by the multi-angle adjustable angle mount. In the first embodiment, the adjustable angle mount preferably includes a ratcheting assembly to allow the user to pivot the projecting stick 120 upward or downward to change the angle of inclination, which can be selectively pivoted in a single plane as much as 150 degrees.

Figure 3:
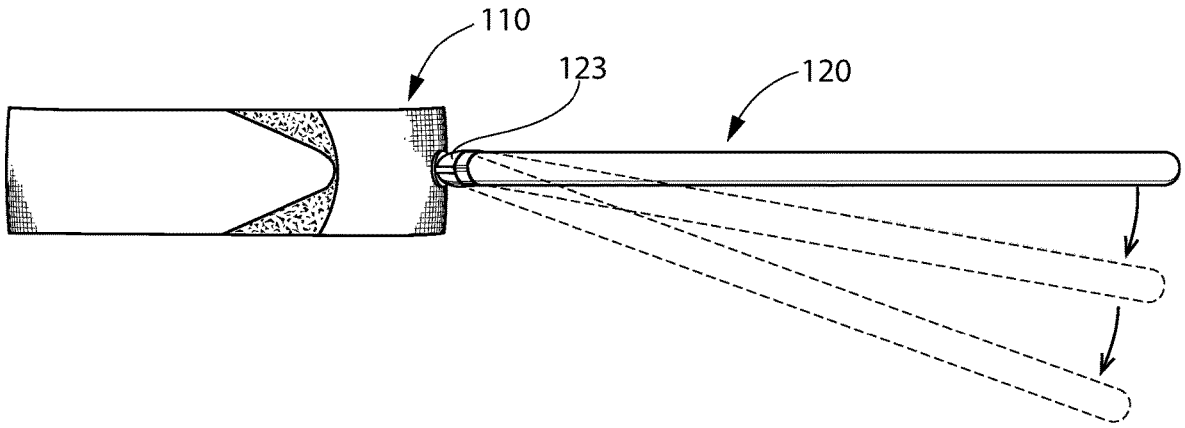
FIG. 3 is a front view of a harness assembly including a chest/waist band with a projecting stick of the first embodiment of the rotation training system of the present invention.
Figure 4:
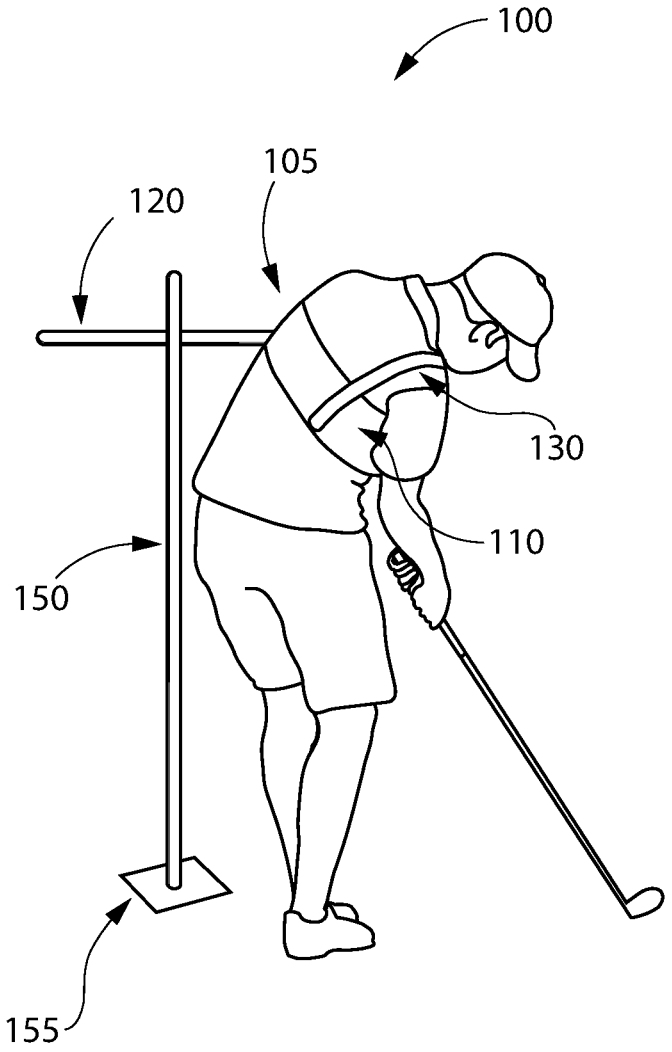
FIG. 4 is a perspective view of a harness assembly including a chest/waist band worn at the chest level with a projecting stick plus the separate upright structure of an embodiment of the rotation training system of the present invention in an environment of use.
Figure 7:
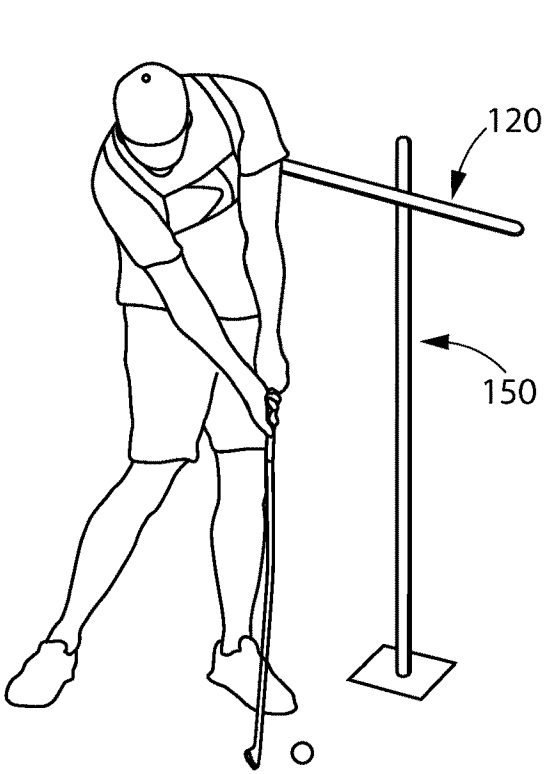
FIG. 7 is a perspective view of a harness assembly worn at the chest level plus the separate upright structure of an embodiment of the rotation training system of the present invention in an environment of use at the time of the backswing.
Figure 6:
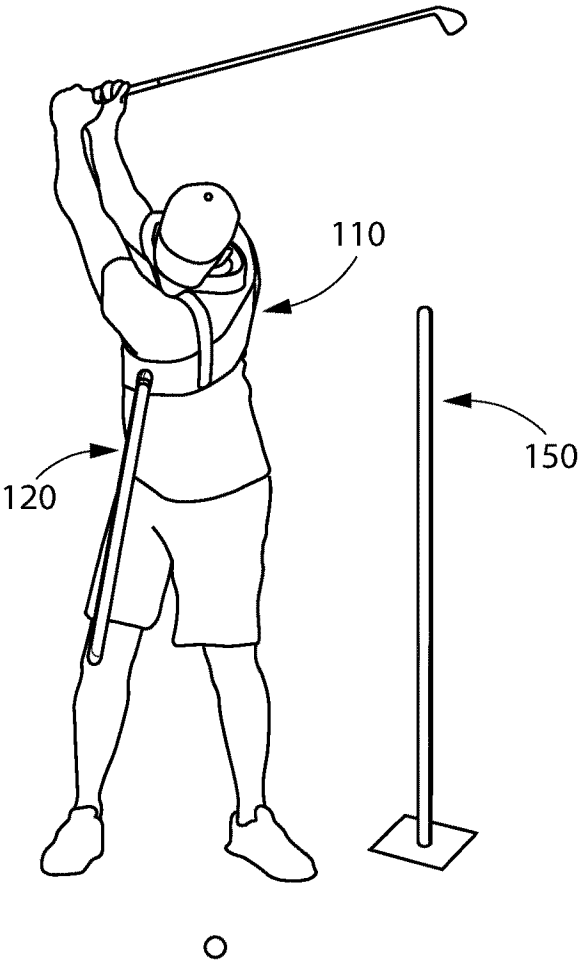
FIG. 6 is a perspective view of a harness assembly worn at the chest level plus the separate upright structure of an embodiment of the rotation training system of the present invention in an environment of use at the time of the forward swing.

The adjustable angle mount 123 is configured to adjust to at least two inclination settings. In the upper position, the projecting stick 120 extends generally horizontally at an inclination angle of about 90 degrees (where the angle is measured between the stick 120 and the vertical portion of the chest/waist band 110 below the band-to-stick connector 125). At the lower inclination angle setting, the projecting stick 120 forms an acute angle (less than 90-degree angle), so that the projecting stick 120 is angled downwardly. In one aspect of the invention, the adjustable angle mount 123 is configured to allow the projecting stick 120 to be positioned at three angles, one of which is approximately 90 degrees and two of which are less than 90 degrees, as depicted in dash lines in FIGS. 1 and 3. In a further aspect, the adjustable angle mount 123 is configured to allow the projecting stick 120 to be positioned at more than three angles. In another aspect the band-to-stick connector 125 further comprises a lock which functions to lock the stick 120 in the selected position.

In the second embodiment of the invention of FIGS. 10-18, the projecting stick 120 is removably connected to the chest/waist band 110 by a band-to-stick connector 125 that, as in the first embodiment, includes a mating portion 127 (FIG. 10) and an angle mount 123. However, in the second embodiment of the invention, the adjustability of the inclination angles is provided by a manual angle mount 123 instead of the adjustable angle mount of the first embodiment. In the second embodiment, the distal portion of the band-to-stick connector 125 comprises a manual angle mount 123 that includes at least two receiving apertures 128. The receiving apertures include a generally straight/horizontal aperture 128S and an angled aperture 128A. Each of the apertures is configured to removably receive the projecting stick 120. The user selects the receiving aperture 128 that provides the desired angle and inserts the proximal end 121 of the projecting stick 120 into the selected receiving aperture 128. When desired, the user can remove the projecting stick 120 from the first receiving aperture 128 and insert it into a second receiving aperture 128. By this manual introduction of the projecting stick 120 into the selected receiving aperture 128, the projecting stick 120 can be oriented in a generally horizontal disposition or can be angled downwardly from horizontal. Preferably a mechanical fastener 126 (such as a screw with a wing nut) secures the stick's proximal end 121 within the selected receiving aperture 128 to provide a secure yet removable connection.

Figure 18:
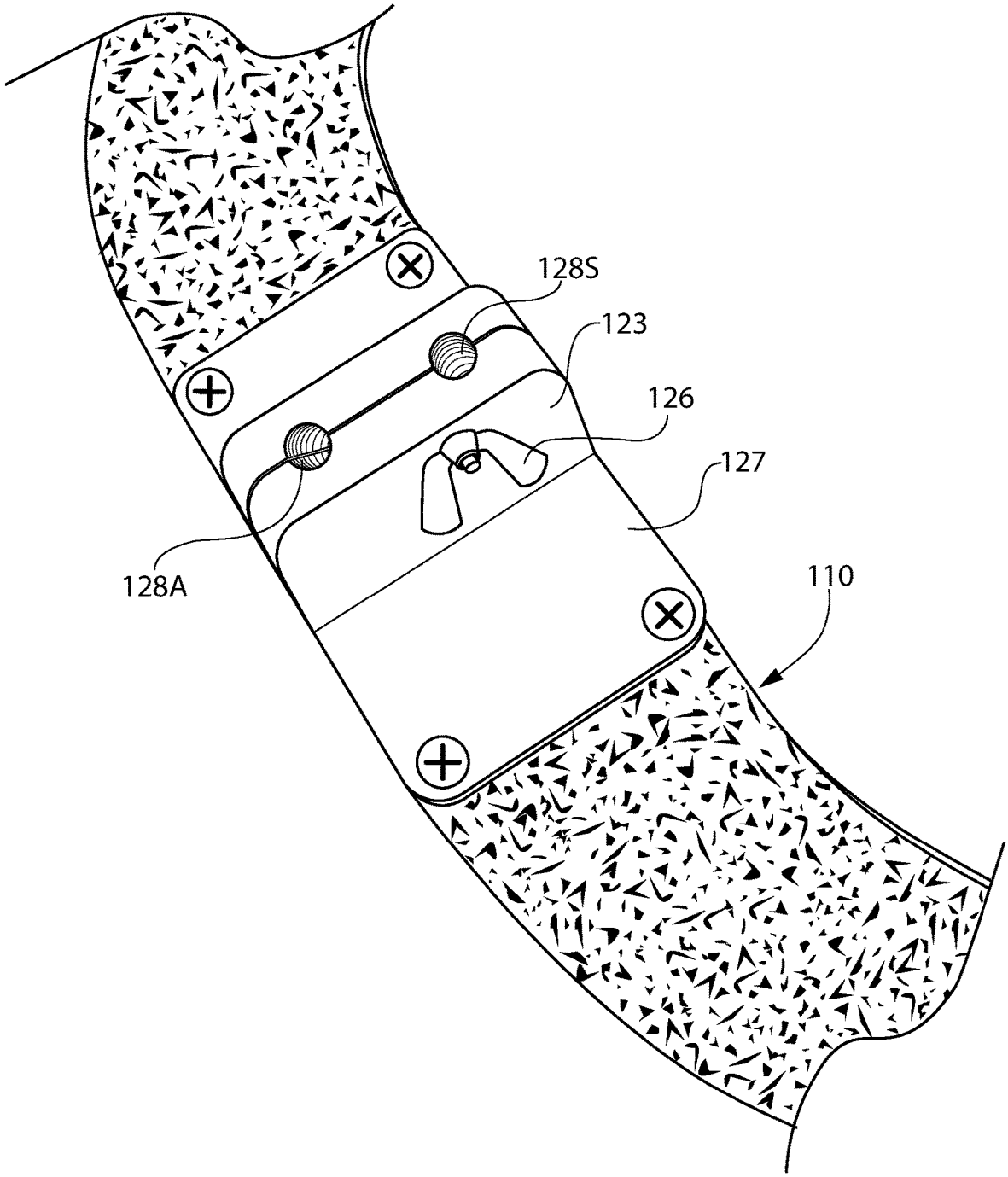
FIG. 18 is a perspective view of a band-to-stick connector and angle mount of the of the second embodiment of the rotation training system of the present invention.

As seen in FIG. 18, the angle mount 123 is preferably formed of two mount members with the receiving apertures 128 positioned at the junction of and between the two mount members so that when the mechanical fastener 126 is tightened, the two halves (mount members) of the angle mount 123 are brought together, which reduces the size of the aperture 128 to tighten the aperture 128 around the stick 120 that has been inserted.

To further assure that the proximal end 121 does not disengage will the sports training system is in use, most preferably the stick's proximal end 121 comprises a friction-increasing material. For example, it may be coated with a thin layer of rubbery material or may be formed with a rubber tip. The friction-increasing material functions to increase the friction between the tip and the receiving aperture to prevent unintentional disengagement and accidents.

An advantage of allowing the user to select between multiple inclination angles is that it allows the sport training system 100 to adapted for use by players having varying heights. While a shorter player may position the stick 120 in the uppermost position (generally parallel to the ground), a taller player may need to position the stick 120 in the lowest position to enable engagement of the stick 120 with the separate upright structure 150. Another advantage of the multiple inclination angles is that multiple angles facilitate the two-in-one usage of the harness assembly 105. The angle of inclination can be easily varied when the location of the harness assembly 105 is changed from the waist to the chest; therefore, the sport training system 100 to be easily used for training either pelvic or thoracic rotation.

In a preferred aspect, the harness assembly further comprises left and right shoulder straps 130, each of which is formed of a long thin band or strip of material. In the preferred aspect of the invention (shown in both the first and second embodiments), the shoulder straps 130 are removable, but in another aspect, they may be fixedly attached. The shoulder straps 130 may be formed of fabric, webbing, canvas, belting material, or similar material. The shoulder straps 130 are removable by use of attachment/detachment connectors 135, such as a G-hook and corresponding loop combination, a button and buttonhole, complementary hook(s) and eye(s), complementary hook and loop fastenings, or other complementary connectors.

In the first embodiment, the shoulder straps 130 are removably attached at the top portion of the chest/waist band 110, and the complementary attachment/detachment connectors 135 are shown as G-hooks to be engaged with loops. The top portion of the chest/waist band 110 is configured with loops, and both ends of both the first and the second shoulder straps 130 are configured with fixedly attached G-hooks. In an aspect that may provide additional versatility and provide convenience for both right-handed and left-handed players, both the top portion of the chest/waist band 110 and the bottom portion of the chest/waist band 110 may be configured with portions of the complementary attachment/detachment system 135. In this aspect the chest/waist band 110 can be easily inverted for use. With the duplicate complementary attachment/detachment system 135, the chest/waist band 110 may be turned 180 degrees to convert the right-handed version of the chest/waist band 110 to the left-handed version.

In the second embodiment, a hook material is disposed on the inner surface of both ends of both the first and the second shoulder straps 130. The inner hook material is complementary to the looped material of the outer surface of the chest/waist band 110. Thus, the attachment/detachment connectors 135 are formed by the combination of the complementary hook and loop fastening materials on the straps 130 and on the band 110, which provides maximum adjustability for user's of all sizes and heights.

In both the first and the second embodiments, the chest/waist band 110 is an open band that is sufficiently long to be fitted around a player's chest and/or waist and that has a distal end 119 that is configured to be releasably joined to a proximal end 111. The distal end 119 and proximal end 111 are configured with complementary portions of a band closure/joining system 140. The closure/joining system 140 is illustrated in the embodiments as complementary hook and loop material, but other complementary joining mechanisms are within the scope of the invention. Examples of the complementary joining mechanisms additionally include, for example, a set of quick connectors, a set of buttons and buttonholes, a set of opposing ties, or other mated pairs of complementary joining mechanisms. A first one of the complementary joining mechanisms is disposed on a first proximal end 111 of the chest/waist band 110, and the complementary second joining mechanism is disposed on the opposing second distal end 119 of the chest/waist band 110.

In another aspect of the invention, the chest/waist band 110 may be formed of an elastic material with sufficient stretch to fit over the head and shoulders of the player, which would negate the need for a band closure/joining system 140.

Figure 10:
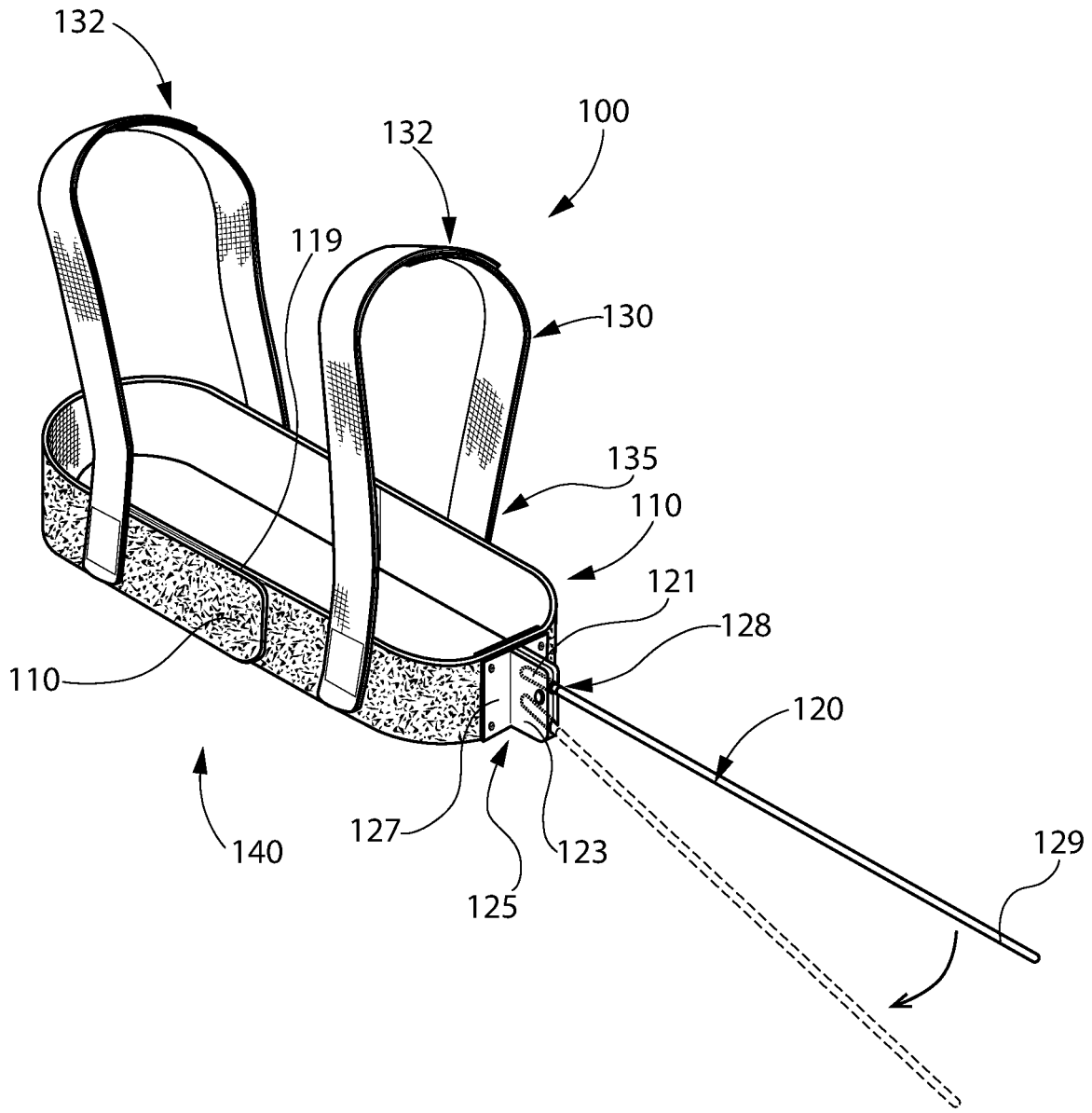
FIG. 10 is a top perspective view of a harness assembly including a chest/waist band with a projecting stick of a second embodiment of the rotation training system of the present invention.
Figure 11:
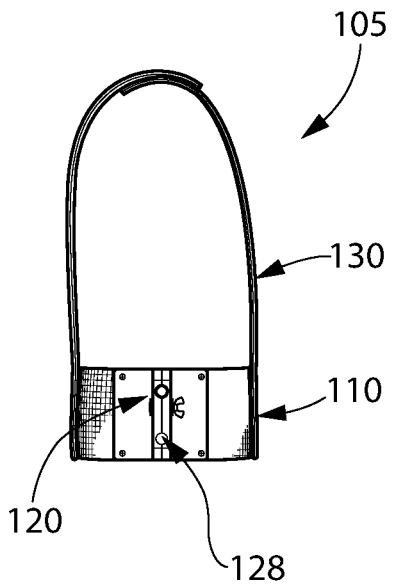
FIG. 11 is a right side view of the harness assembly of the second embodiment of the rotation training system of the present invention with the projecting stick in the upper-angled position.
Figure 12:
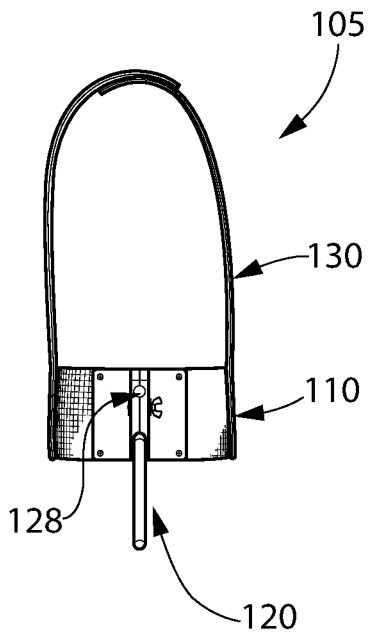
FIG. 12 is a right-side view of the harness assembly of the second embodiment of the rotation training system of the present invention with the projecting stick in the lower-angled position.
Figure 13:
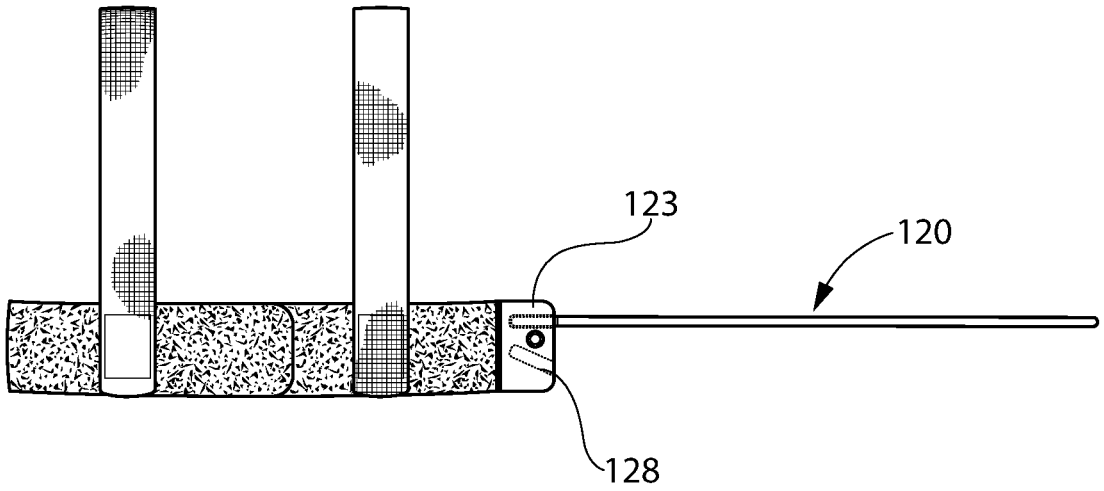
FIG. 13 is a front view of the harness assembly of the second embodiment of the rotation training system of the present invention with the projecting stick in the upper-angled position.
Figure 14:
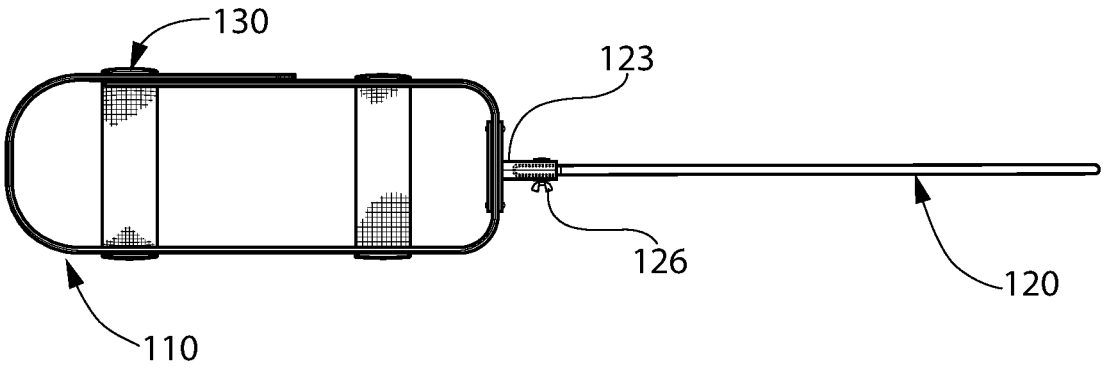
FIG. 14 is a bottom view of the harness assembly of the second embodiment of the rotation training system of the present invention.
Figure 15:
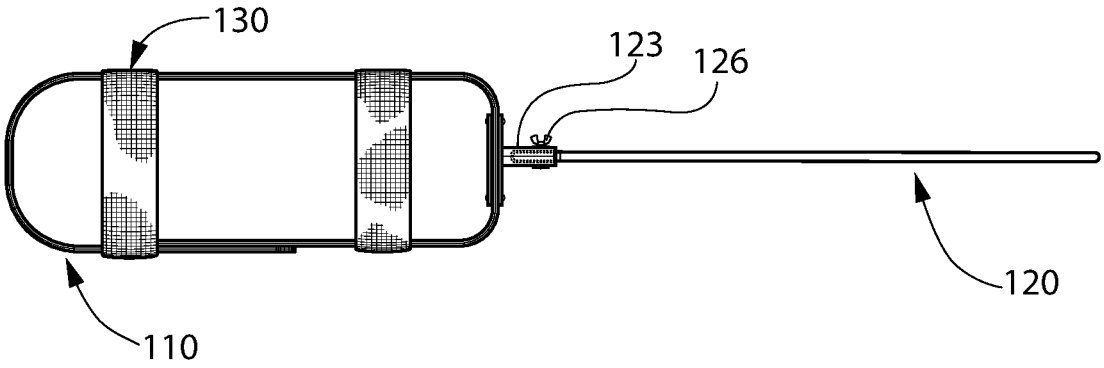
FIG. 15 is a top view of the harness assembly of the second embodiment of the rotation training system of the present invention.
Figure 16:
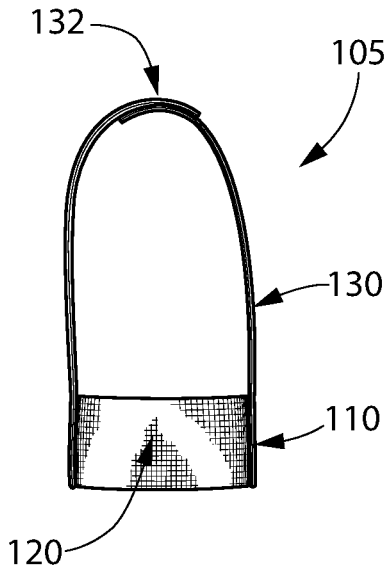
FIG. 16 is a left side view of the harness assembly of the second embodiment of the rotation training system of the present invention.
Figure 17:
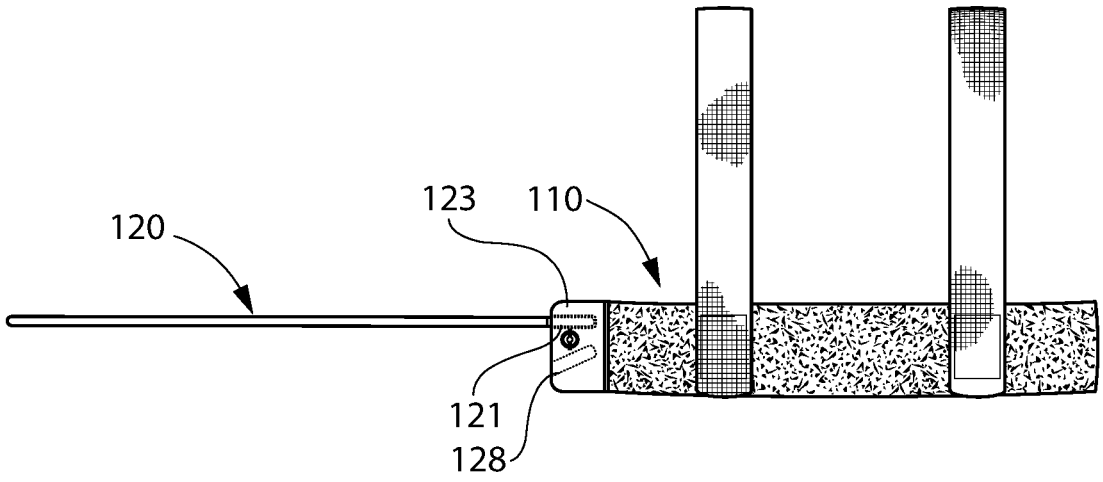
FIG. 17 is a back view of the harness assembly of the second embodiment of the rotation training system of the present invention with the projecting stick in the upper-angled position.

In the second embodiment of the invention, the chest/waist band 110 is formed of a fabric having an outer surface covered in a dense looped material, which is the loop material of a complementary hook and loop closure system, such as that sold under the brand name of VELCRO. The inner surface of one end of the chest/waist band 110 has an additional supplementary section of complementary hook material, which can be attached to the outer surface of the opposing end of the chest/waist band 110 to fit and secure the chest/waist band 110 around the user. Thus, the supplementary section of hook material (disposed on the inner surface of the band's proximal end 111) interlocks with the loop material of the outer surface of the band's distal end 119 (FIG. 10). Therefore, in the second embodiment, the band closure/joining system 140 is formed by the interlocking of an inner section of hook material and the outer surface of the distal end 119 of the chest/waist band 110.

Both forward and rearward ends of the right and left shoulder straps 130 are configured with a dense arrangement of tiny hooks, which is the hook fabric of the complementary hook and loop closure system. In this preferred embodiment, the shoulder straps 130 can readily be moved to any position for engagement with the outer surface of the chest/waist band 110.

The second embodiment also demonstrates a mid-strap connection 132 (FIG. 10) on each of the right and left shoulder straps 130, which provides even more customization of the fit of the sport training system 100. The mid-strap connection 132 is formed by an intermediary set of complementary hook and loop fabric fasteners disposed within a middle portion of both the first and the second shoulder straps 130. Therefore, each of the right and left shoulder straps have a front strap portion and a back strap portion. Though one end of each of each of the front strap portion and of the back strap portion attaches to the band 110, the opposing midpoint ends of the front and back strap portions are configured with a midpoint portion of complementary hook and loop material so that said midpoint portions can be joined together in the mid-strap connection 132.

Thus, the second embodiment maximizes the adjustability of the chest/waist band 110 and of the shoulder straps 130, so that it can fit users of many ages and of many body types. Once adjusted to fit a particular user, the straps need not be totally removed, but can be disconnected at only one end to aid in retaining the preferred fit.

The chest/waist band 110 can be positioned at the chest or at the waist of the player being trained. When the chest/waist band 110 is worn as a chest harness, the outwardly projecting stick 120 protrudes laterally from the body's midline just under the player's lead armpit. During the swing practice, the projecting stick 120 will engage with a separate upright structure to provide feedback to the player to inform the player if his/her chest was opened enough before the sports implement's impact with the ball. The shoulder straps 130 of the chest/waist band 110 can be removed and the chest/waist band 110 can be repositioned at the waist. In this second use case, the feedback will indicate to the player the sufficiency of rotation of his/her pelvis before impact with the ball.

The harness assembly 105 of the first and second embodiment may be sold alone for use with a separate upright structure provided by the player, the player's trainer, a training facility, or the like.

In the third embodiment, the rotation training system 100 not only includes the harness assembly 105, but it also includes a separate upright structure 150. In a further aspect of the third embodiment, the rotation training system 100 may include more than one separate upright structure 150, such two upright structure 150 to train forward and backward rotation on the same swing.

The separate upright structure 150 may comprise a pole, shaft, stick, pipe, wand, or other relatively long, straight, slender, vertically disposed object, referred to generally as pole 151. The vertically disposed pole 151 is preferably cylindrical in cross section, though its cross section may instead by in the form of a square, rectangle, pentagon, or other geometric shape. The vertically disposed pole 151 may be formed of metal, wood, nylon, or other natural or manmade material. The height of the vertically disposed pole 151 of the upright structure 150 may preferably be in the range of from 4.5 feet to 9 feet tall. The width of the vertically disposed pole 151 is preferably from ¼ inch to 3 inches.

The vertically disposed pole 151 is positioned upright (approximately perpendicular to the ground) in a location that allows it to be struck by the projecting stick 120 during the player's swing. The placement of the separate upright structure 150 can be varied to create feedback for the particular rotation being taught. For example, it may be positioned to the left side of a golf player to provide feedback for the rotation during the swing. It (or a second separate upright structure 150) may be positioned slightly to the right of the center of the player and slightly forward so that the player points the end of the projecting stick 120 at the separate upright structure 150 at the top of the backswing.

In one aspect, the vertically disposed pole 151 of the upright structure 150 may be inserted directly into the ground—if desired and if conditions allow. In another aspect of the invention, the upright structure 150 further comprise a base 155. The vertically disposed pole 151 may be attached to, or attachable to, the base 155. The base 155 extends horizontally beyond the width of the vertically disposed pole 151 to provide a foundation to support the pole 151. This aspect provides advantages in that the upright structure 150 may be easily moved and repositioned and in that the upright structure 150 may be used without disturbing the grass or ground.

In one aspect of the invention, the base 155 is fixedly attached to the bottom end of the vertically disposed pole 151. In another aspect of the invention, the vertically disposed pole 151 may be attachable to, and detachable from, the base 155. This aspect may provide advantages for packaging, shipping, and storage by the manufacturer and/or retailer and for transport of the system by the player.

In yet another aspect of the invention, the vertically disposed pole 151 of the upright structure 150 may not be formed of a single object or element, but it may be modular with connections joining the modules. The modular portions have ends configured with complementary connections. To assembly this multi-part pole 151, the modular portions are joined (using the complementary connections) to create a long pole-like structure 151. This aspect of the invention may also provide advantages in packaging, shipping, and storage.

Typically, the separate upright structure 150 is freestanding and freely repositionable. But in another aspect of the invention, it may not be freely repositionable. For example, it may be permanently installed into a training facility floor or attached to a standoff from a training facility wall.

Figure 9:
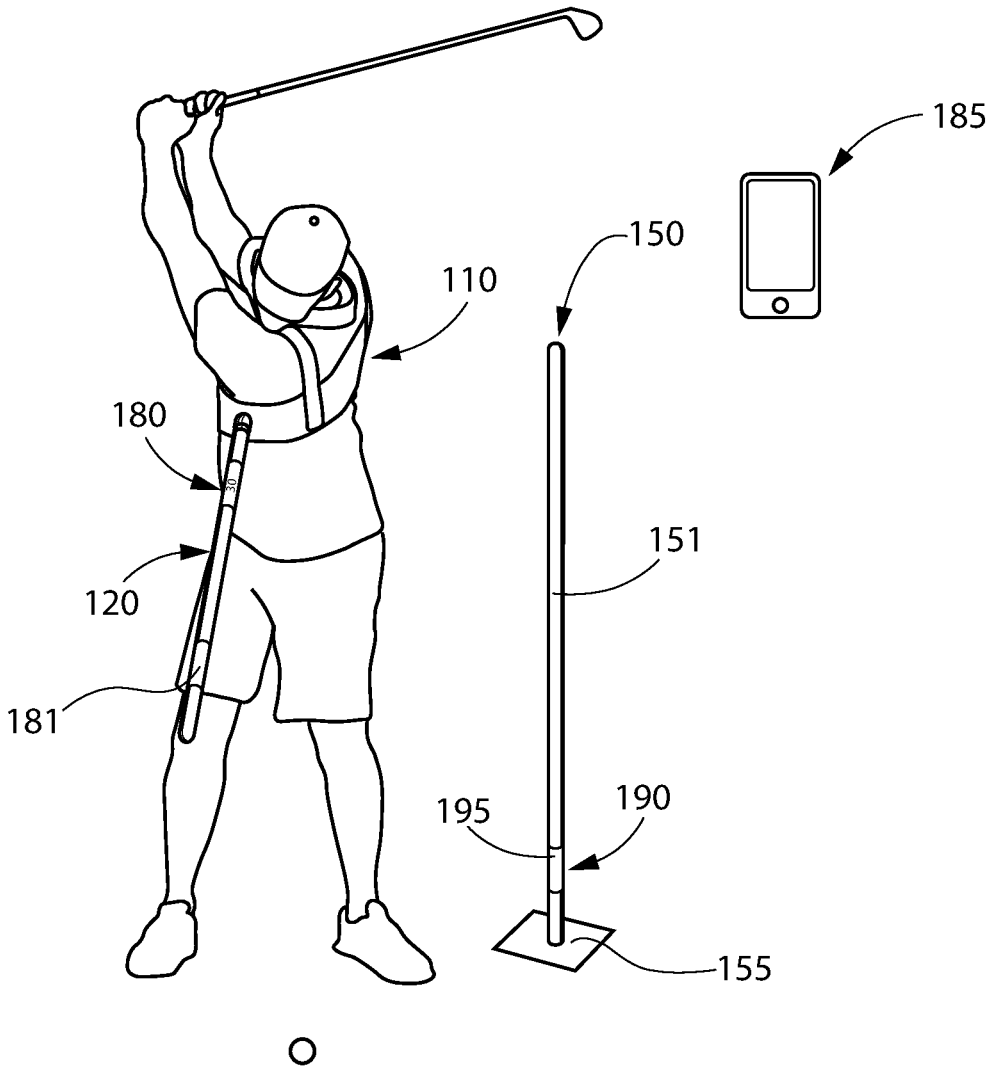
FIG. 9 is a perspective view of a harness assembly including a chest/waist band worn at the chest level with a projecting stick, a separate upright structure, system electronics, and a report system of an embodiment of the rotation training system of the present invention in an environment of use.

In the fourth embodiment of FIG. 9, the rotation training system of the present invention may suitably comprise, consist of, or consist essentially of harness assembly 105, a separate upright structure 150, and an electronics system 180, 190 for determining at least the degree of rotation.

The electronics system 180, 190 of the fourth embodiment includes electronic components to measure the rotation angle, a processing system, and a reporting system to report the rotation angle to the player and/or his/her trainer. The electronics system may include upright electronic components 190 disposed in or on the upright structure 150 and/or stick electronic components 180 disposed in or on the projecting stick 120 or band 110. The stick electronic components 180 may include a rotary position sensor to transform the mechanical rotary position of the projecting stick 120 into electrical signals. The electrical signals are input into the processor. The stick electronic components 180 and/or the upright electronic components 190 may also include an impact sensor 195, which outputs timing data to the processor. The processor outputs the degree of rotation achieved by the player before the moment of impact. The reporting system provides the angle of rotation via a display or auditory signal, such as to a local display 181 or to a smartphone 185.

In this embodiment, the chest/waist band 110 has been attached to the player intending to engage in rotational movement. The projecting stick 120 protrudes from the chest/waist band 110 at the side of the player. As the player practices the swing, rotation of the player and of the projecting stick 120 occurs, and the projecting stick 120 collides with the pole 151 upright of the structure 150. During this process, the rotational data of the movement is measured by the rotatory position sensor, and the impact data from the collision between the protruding stick 120 and pole 151 is measured by the impact sensor 190.

In one aspect of the invention the rotational data from the chest/waist band 110 and projecting stick 120 as well as the impact data from the collision of the projecting stick 120 and upright structure is analyzed by the processor and reported on a display 181 on the projecting stick 120 and/or upright structure 150. Or the data may be reported via an auditory signal.

In another aspect of the invention the rotational data from the chest/waist band 110 and projecting stick 120 as well as the impact data from the collision of the projecting stick 120 and upright structure is analyzed by the processor and reported on the display of a tablet, smartphone, or another personal electronic device 185 or may be reported via an auditory signal produced by the personal electronic device 185.

Figure 19:
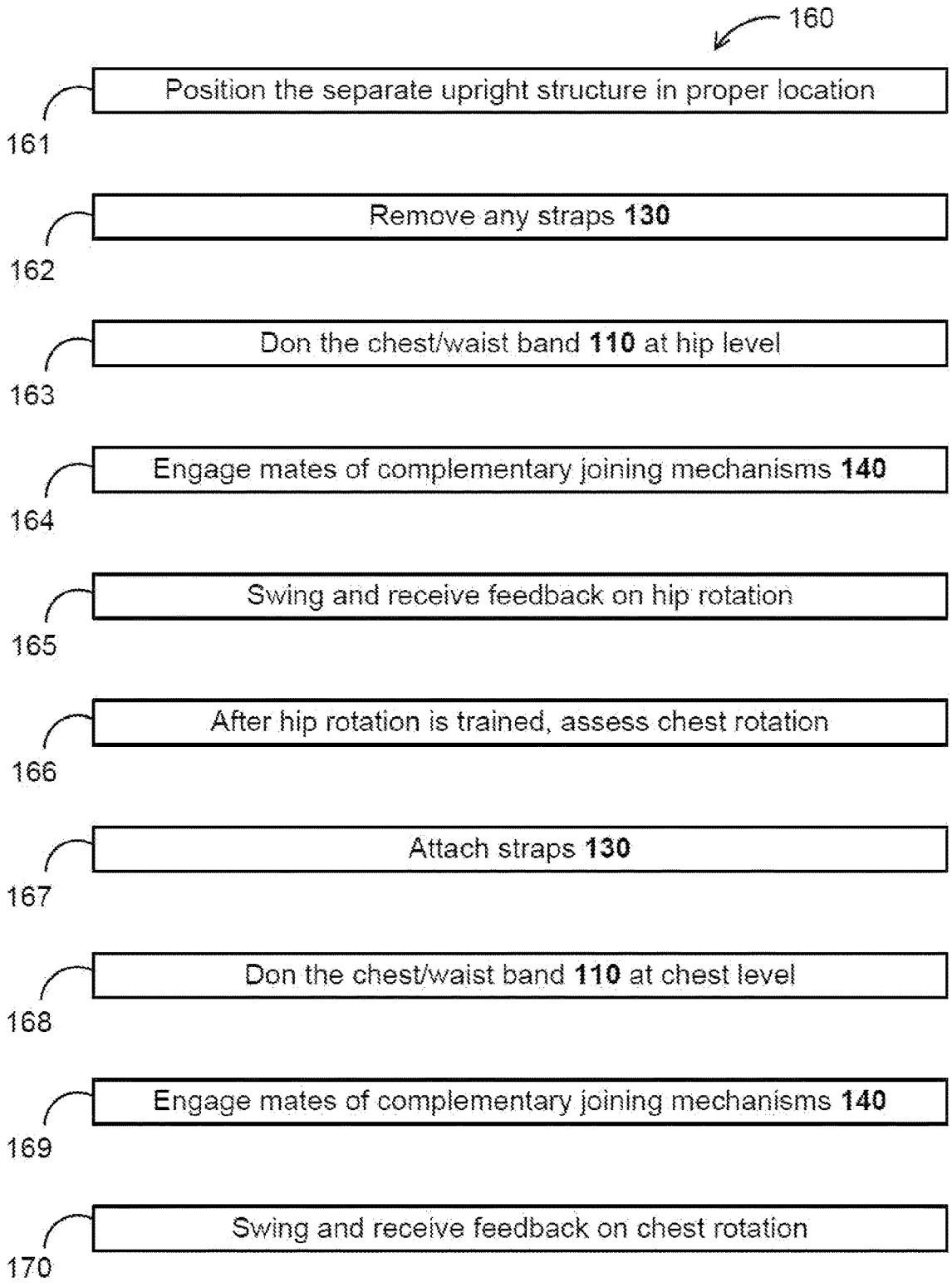
FIG. 19 is a flowchart showing the method of use of an embodiment of the rotation training system of the present invention.

The flowchart of FIG. 19 provides exemplary steps 160 in the preferred use of the rotation training system 100 of the present invention. In this example, the player first trains the amount of lower body rotation, which is a first step in encouraging the rotation of the upper body both in the backswing and downswing. This has been observed to be true not only in golf (as in the illustrations) but also in other sports such as baseball and tennis.

Figure 5:
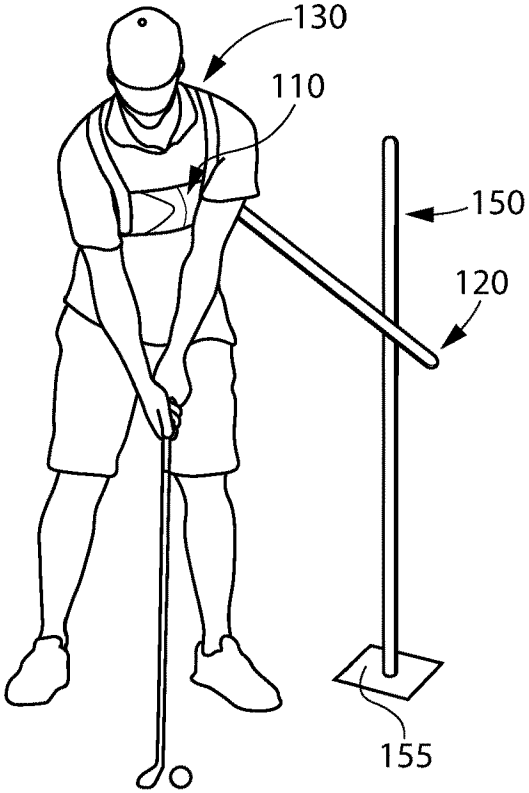
FIG. 5 is a perspective view of a harness assembly worn at the chest level plus the separate upright structure of an embodiment of the rotation training system of the present invention in an environment of use at the point in time in which the player addresses the ball.

In step 161 the player who will be training (or another person such as a trainer) positions the separate upright structure 150 in the proper position for the movement to be practiced, i.e., it is positioned appropriately to give feedback when the proper degree of rotation has been achieved. In the golf downswing, the ideal goal is 35-45 degrees of pelvic rotation. As seen in FIG. 5, to practice thoracic rotation of the body during a golf swing, the upright structure 150 is positioned to the left of the player at a distance from the side of the player that is less than the length of the projecting stick 120.

In step 162, if desired any straps 130 that are attached to the chest/waist band 110 may be removed, or one end of each strap may be disconnected with one end remaining connected to allow for a quick reconnection when the chest/waist band 110 is moved to the chest position.

Figure 8:
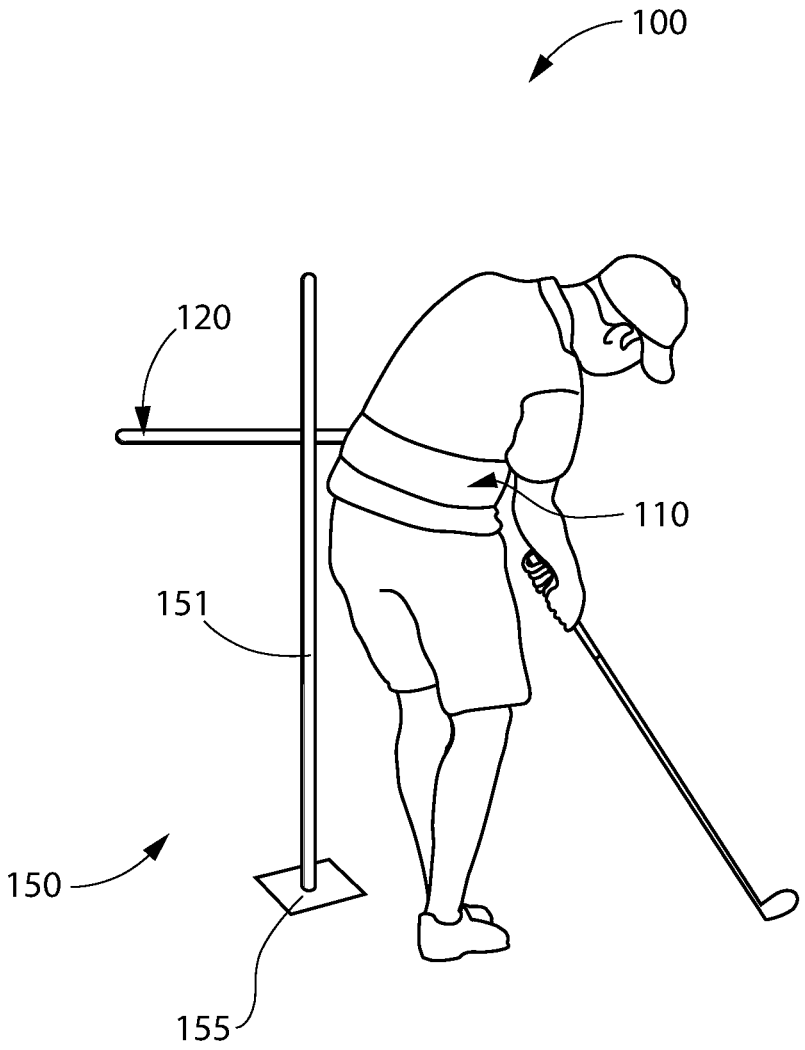
FIG. 8 is a perspective view of a harness assembly worn at the waist level plus the separate upright structure of an embodiment of the rotation training system of the present invention in an environment of use at the moment of impact.

In step 163 the chest/waist band 110 is donned and positioned in the location to be trained, which in this example, is the waist, as seen in FIG. 8.

In these steps, the chest/waist band 110 includes a closure/joining system 140 with one or more mated pairs of the complementary closure/joining mechanisms, so the chest/waist band 110 is wrapped around the player's waist. Then in step 164, a first portion of the complementary joining mechanism is engaged with the complementary second portion of the joining mechanism to join the band's proximal end 111 and the distal end 119 of the band 110. At this point, the projecting stick 120 will protrude laterally from the player's midline at the player's waist.

In this illustration the player is a golfer. In the downswing, the projecting stick 120 engages with the vertically disposed pole 151 of the separate upright structure 150. Feedback (auditory, tactile, and/or electronic) is actuated by the engagement. The player's goal is to rotate his/her hips around 35-45 degrees before making impact with the ball.

Once the player has trained to rotate his/her hips consistently to about 35-45 degrees, he/she may instinctively rotate the chest the desired amount. In step 166, the player's trainer assesses the chest rotation. If she/he does not open the chest sufficiently, the two-in-one chest/waist band 110 can be used in a further series of steps.

In step 167 the straps 130 are attached to the top of the chest/waist band 110 using the attachment/detachment complementary system 135.

In step 168, the chest/waist band 110 is positioned at the chest level with the shoulder straps 130 resting on the shoulders. In the aspect in which a mid-strap connection 132 is provided, the midpoint portion of complementary hook and loop material mid-strap portions of each of the left strap and the right strap may be joined at the mid-strap connection 132, which allows the user to further customize the fit of the harness assembly 105.

In step 169, the mates of the complementary closure/joining mechanisms 140 are connected to hold the chest/waist band 110 securely in place.

In step 170, the player then practices his/her swing and attempts to open the chest while causing the projecting stick 120 to impact the vertically disposed pole of the separate upright structure 150. The player receives auditory and/or tactile feedback at the moment of impact, and, in the fourth embodiment, also receives electronic or digital feedback.

The dual waist and chest positioning allows the sport training system 100 of the present invention to be used as a two-in-one device. Once the player gains the feel for a proper lower body sequence by wearing the chest/waist band 110 at the waist level (steps 161 to 165), the player may additionally wear the chest/waist band 110 as a chest harness to ensure that his/her upper body opens prior to impact (steps 167 to 170). Consequently, the golf player is able achieve pointing the front of his/her chest beyond the ball and down range, in the direction of the intended target.

The sport training system 100 may be used by right-handed or left-handed players. Typically, a right-handed player dons the chest/waist band 110 in a position in which the projecting stick 120 protrudes from the left side of his/her body. Typically, a left-handed player dons the chest/waist band 110 in a position in which the projecting stick 120 protrudes from the right side of his/her body. However, players with either dexterity may wear the chest/waist band 110 in the opposite orientation to practice other motions. These two orientations can be achieved by merely turning the chest/waist band 110 approximately 180 degrees. In another aspect, a portion of the attachment/detachment complementary system 135 may be disposed on both the upper and lower portions of the band 110 to allow easy inversion of the band 110 for use by players with either dexterity.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A sports training system comprising:

a harness assembly comprising:

a chest/waist band comprising a band front portion, a band back portion, and two opposing band side portions;

a projecting stick disposed at one of said two opposing band side portions and extending outwardly at least 1 foot from said chest/waist band;

a band-to-stick connector disposed on one of said two opposing band side portions that connects said projecting stick to said chest/waist band: wherein said band-to-stick connector comprises an angle mount that allows said projecting stick to be positioned at least at a first angle and at a second angle; wherein said angle mount is a manual angle mount with at least two receiving apertures each of which can receive a proximal end of said projecting stick; and an upright structure that is separate from said harness assembly and that comprises a vertically disposed pole to be positioned in a location so that when a sports player rotates his body while swinging a sports implement, said projecting stick engages with said vertically disposed pole.

2. The sports training system as recited in claim 1, wherein said angle mount is an adjustable angle mount.

3. The sports training system as recited in claim 2, wherein said adjustable angle mount comprises a ratcheting assembly to change the angle of inclination of said projecting stick.

4. The sports training system as recited in claim 1, wherein said proximal end of said projecting stick comprises a friction-increasing material to increase the friction between said proximal end and a selected one of said at least two receiving apertures.

5. The sports training system as recited in claim 1, wherein:

said angle mount comprises two mount members and a mechanical fastener;

said at least two receiving apertures are disposed between said two mount members;

said mechanical fastener draws said two mount members toward one another causing said a least two apertures to tighten.

6. The sports training system as recited in claim 1, wherein said harness assembly further comprises a right shoulder strap and a left shoulder strap; and wherein said chest/waist band further comprises an attachment/detachment connector to allow connection of said right shoulder strap and said left shoulder strap to said chest/waist band.

7. The sports training system as recited in claim 1, wherein:

said chest/waist band comprises an outer surface of a dense looped material and a supplementary section of complementary hook material disposed on the interior of said chest/waist band to allow manual engagement of said supplementary section of complementary hook material with said outer surface of said dense looped material;

said harness assembly further comprises a right shoulder strap and a left shoulder strap;

each of said right shoulder strap and said left shoulder strap comprise a first end, a second end, a first hook material fixedly attached to an inner surface of said first end, and a second hook material fixedly attached to an inner surface of said second end;

wherein said first hook said material is attachable to said outer surface of said chest/waist band; and wherein said second hook material is attachable to said outer surface of said chest/waist band.

8. The sports training system as recited in claim 1, wherein:

said harness assembly further comprises a right shoulder strap and a left shoulder strap;

each of said right shoulder strap and said left shoulder strap comprises a front strap portion and a back strap portion; and said front strap portion and said back strap portion include a midpoint portion of complementary hook and loop material so that said midpoint portion of complementary hook and loop material can be joined together in a mid-strap connection.

9. A sports training system comprising:

a harness assembly comprising:

a chest/waist band comprising a band front portion, a band back portion, and two opposing band side portions;

a projecting stick disposed at one of said two opposing band side portions and extending outwardly at least 1 foot from said chest/waist band; and an upright structure that is separate from said harness assembly and that comprises a vertically disposed pole to be positioned in a location so that when a sports player rotates his body while swinging a sports implement, said projecting stick engages with said vertically disposed pole; and an electronics system and a report system to provide notification of a rotation of said projecting stick from a start of said swing to an impact with said upright structure.

10. A sports training system comprising:

a harness assembly comprising:

a chest/waist band comprising a band front portion, a band back portion, two opposing band side portions, and a band-to-stick connector disposed on one of said two opposing band side portions;

shoulder straps that are removably attachable to said chest/waist band;

a projecting stick attachable to said band-to-stick connector; wherein when said projecting stick is attached to said band-to-stick connector it extends outwardly at least 1 foot from said chest/waist band; wherein said band-to-stick connector comprises an angle mount that allows said projecting stick to be positioned at least at a first angle and at a second angle; and wherein said angle mount is a manual angle mount comprising an upper receiving aperture and a lower receiving aperture each of which can receive a proximal end of said projecting stick; and an upright structure that is separate from said harness assembly and that comprises a vertically disposed pole positioned in a location so that when a sports player rotates to swing a sports implement, said projecting stick engages with said vertically disposed pole.

11. The sports training system as recited in claim 10, wherein said angle mount is an adjustable angle mount.

12. The sports training system as recited in claim 10, wherein said proximal end of said projecting stick comprises a friction-increasing material to increase the friction between said proximal end and said upper receiving aperture and to increase the friction between said proximal end and said lower receiving aperture.

13. The sports training system as recited in claim 12, wherein said angle mount comprises two mount members and a mechanical fastener;

said mechanical fastener draws said two mount members closer to retain said proximal end of said projecting stick within a selected one of said upper receiving aperture or said lower receiving aperture.

14. A sports training system comprising:

a harness assembly comprising:

a chest/waist band comprising a band front portion, a band back portion, two opposing band side portions, and a band-to-stick connector disposed on one of said two opposing band side portions;

shoulder straps that are removably attachable to said chest/waist band;

a projecting stick attachable to said band-to-stick connector; wherein when said projecting stick is attached to said band-to-stick connector it extends outwardly at least 1 foot from said chest/waist band; wherein said band-to-stick connector comprises an angle mount that allows said projecting stick to be positioned at least at a first angle and at a second angle; and an upright structure that is separate from said harness assembly and that comprises a vertically disposed pole positioned in a location so that when a sports player rotates to swing a sports implement, said projecting stick engages with said vertically disposed pole; and an electronics system and a report system to provide notification of a rotation of said projecting stick from a start of said swing to an impact with said upright structure.

15. The sports training system as recited in claim 14, wherein:

said chest/waist band comprises an outer surface of a dense looped material and an inner portion of complementary hook material positioned to allow manual engagement of said inner portion of complementary hook material with said outer surface of said dense looped material; and said shoulder straps each comprise a first hook material fixedly attached to an inner surface of a first end of each of said shoulder straps and a second hook material fixedly attached to an inner surface of a second end of each of said shoulder straps; wherein said first hook material is attachable to said outer surface of said chest/waist band; and wherein said second hook material is attachable to said outer surface of said chest/waist band.

16. The sports training system as recited in claim 14, wherein each of said shoulder straps comprises a mid-strap connection.

17. The sports training system as recited in claim 14, wherein said upright structure further comprises a base that can removably receive said vertically disposed pole.

* * * * *